United States Patent [19]

Tomaszewski et al.

[11] Patent Number: 4,531,339

[45] Date of Patent: Jul. 30, 1985

[54] CHANNEL END CAP

[75] Inventors: Walter Tomaszewski, Canton; James H. C. Yang, Cleveland, both of Ohio

[73] Assignee: The Firestone Tire & Rubber Company, Akron, Ohio

[21] Appl. No.: 603,256

[22] Filed: Apr. 23, 1984

[51] Int. Cl.[3] ..... E04F 19/00

[52] U.S. Cl. ..... 52/716; 52/301; 248/188.9

[58] Field of Search ..... 52/301; 248/188.9; 5/281; 24/460

[56] References Cited

U.S. PATENT DOCUMENTS

| | | | |
|---|---|---|---|
| 1,893,910 | 1/1933 | Silverman | 248/188.9 |
| 1,928,933 | 10/1933 | Goldberg | 248/188.9 |
| 2,011,785 | 8/1935 | Vallone | 248/188.9 |
| 3,563,581 | 2/1971 | Sommerstein | 287/189.36 |
| 4,066,285 | 1/1978 | Hall et al. | 52/716 |
| 4,168,921 | 9/1979 | Blanchard | 403/19 |

*Primary Examiner*—James L. Ridgill, Jr.
*Attorney, Agent, or Firm*—Ernst H. Ruf

[57] ABSTRACT

A channel end cap for use, in a mechanical fastening system for mechanically securing a flexible sheet, with a channel member of generally rectangular form, in transverse cross section, wherein the end cap is comprised of a flexible resilient material of a shape generally corresponding to that of the channel member and having first bottom, side and top wall portions separated by an intermediate abutment means from second bottom, side and top wall portions, extending from their corresponding first wall portions, axially outwardly of the channel member axial outer end surface, with the abutment means acting as stop means and abutting the channel member axial outer end surface.

16 Claims, 7 Drawing Figures

CHANNEL END CAP

TECHNICAL FIELD

The field of art to which this invention pertains is that of mechanical fastening systems, particularly to channel end caps for attachment devices for mechanically securing a flexible sheet, without puncturing same, within a channel member via either a flexible resilient insert member or a ductile rigid insert member, adapted for fixedly retaining the flexible sheet within the channel member.

BACKGROUND OF THE ART

Co-pending U.S. application Ser. No. 516,622 to Yang, et al., filed July 25, 1983, and assigned to common assignee, discloses a mechanical fastening system for securing a flexible sheet within a channel member via an insert member wherein the latter is made of a flexible resilient material having a central longitudinal flex notch that serves to define two adjacent wing portions and permits a temporary elastic deformation of the insert member into an inverted V-shape for insertion of the insert member, together with adjacent portions of the flexible sheet, into the channel member. In the interest of full disclosure, this application is incorporated herein by reference to the extent necessary to explain this particular mechanical fastening system.

Co-pending U.S. application Ser. No. 516,618 to Yang, et al., filed July 25, 1983 and assigned to common assignee, discloses a further attachment device for securing flexible sheets within a channel member via an insert member of generally inverted V-shape wherein the latter is made of a ductile but rigid material having a central longitudinal material portion of reduced rigidity that serves to define two adjacent wing portions and permits the subsequent plastic deformation of the insert member into its installed shape after its insertion, together with adjacent portions of the flexible sheet, into the channel member. Again, in the interest of full disclosure, this application is incorporated herein by reference to the extent necessary to explain this particular attachment device.

In both the previously-noted mechanical fastening system and attachment device, preferably metallic channel members are utilized to produce long tracks, with these tracks having ends, which are either factory cuts or field end cuts. These end cuts may cause occasional flexible sheet or membrane damage (cutting) during the installation process. It has also been determined as a result of lab testing, particularly during wind uplifting tests of the membranes, that these track or channel member ends may cause premature membrane failure, principally via tearing, due to sharp-edged channel ends.

DISCLOSURE OF THE INVENTION

The present invention provides a solution to the problem of possible cutting and/or tearing of the flexible sheets or membranes by utilizing an end cap physically secured to the end portion of a track or channel and covering the axial outer end surface thereof. The end cap is comprised of a flexible resilient material of a generally rectangular form, in transverse section, and of a predetermined axial extent having first bottom and side wall portions enveloping the corresponding adjacent walls of the channel member and the first top wall portions enveloping at least the transverse outermost portions of the channel member top walls.

The end cap of the present invention further includes second bottom, side and top wall portions extending respectively, from its corresponding first wall portions, axially outwardly of the channel member axial outer end surface, and abutment means intermediate of first and second wall portions acting as stop means and abutting the channel member axial outer end surface, thereby inhibiting not only any possible cutting or tearing but also assisting in and simplifying the installation of the insert member into the channel member.

The abutment means preferably takes the form of step areas intermediate and perpendicular to the first and second wall portions of at least the end cap bottom and side walls, with the wall thickness of the channel members preferably being of a thickness substantially similar to that of the perpendicular extent of the step areas.

In a preferred embodiment of the end cap of this invention, its first bottom wall portion is provided with an aperture of size sufficient to retain a protrusion in the bottom wall of the channel member in a manner so as to physically bias the channel member axial outer end surface against the end cap abutment means.

Other features and advantages of the present invention will become more readily understood by persons skilled in the art when following the best mode description in conjunction with the several drawings.

BEST MODE FOR CARRYING OUT THE INVENTION

Figure 1:
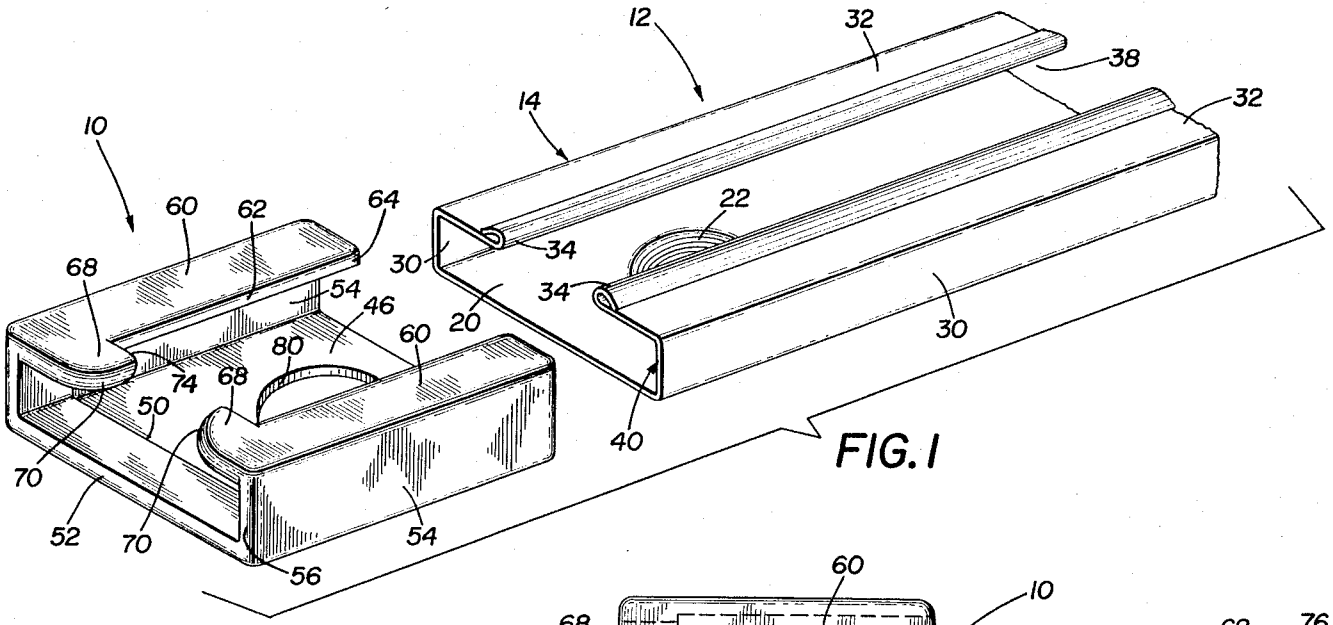
FIG. 1 is an exploded view, in perspective, of the channel end cap of the present invention together with a channel member, in the unassembled condition.

Referring now to the drawings, specifically FIG. 1, there is illustrated in an exploded view, in perspective, the channel end cap 10 of the present invention which is designed to fit over and substantially envelop an end portion 14 of a channel member 12, in a manner to be described hereinafter.

Figure 6:
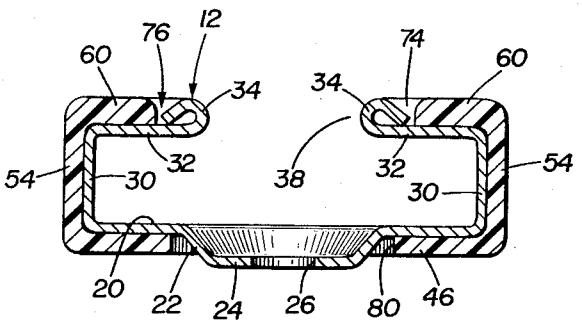
FIG. 6 is an enlarged transverse sectional view taken on line 6—6 of FIG. 4.

Channel member 12, as best seen in FIGS. 1 and 6 and usually of a rigid, preferably metal construction of finite length and predetermined material thickness t (FIG. 5), is of generally rectangular form in transverse cross section (see FIG. 6) having a substantially flat bottom wall 20 which in turn may be provided with a plurality (one shown) of longitudinally spaced outwardly directed protrusions or recesses 22 each provided with a bottom wall 24 having a central aperture 26, the latter permitting the passage therethrough of the body portion of a fastener (not shown). The ends of channel bottom wall 20 merge into opposed, similarly projecting parallel side walls 30, which in turn merge into inwardly directed and converging spaced top walls 32, parallel to and equally spaced from bottom wall 20, whose opposite inner but spaced smooth and opposed turned-over edge portions 34, serve to define a constricted central longitudinal slot or opening 38. The axial end outer surface of channel member 12, as defined by the axial outer end surfaces of walls 20, 30, 32 and edge portions 34 is denominated by numeral 40. It should also be noted that if protrusions 22 are utilized, they are of a predetermined common diameter and spaced a predetermined distance from each other (not shown) and centered a predetermined distance a (FIG. 5) from channel axial end surface 40.

Figure 2:
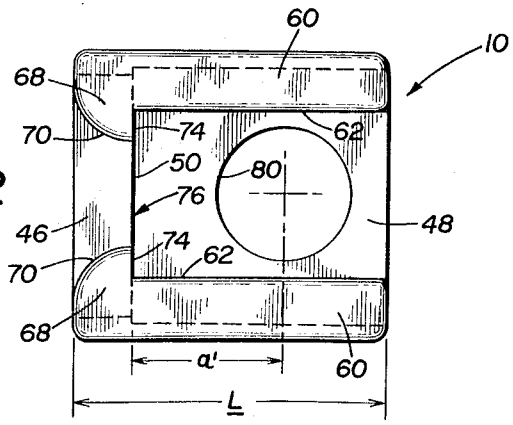
FIG. 2 is a top plan view of the channel end cap.
Figure 3:
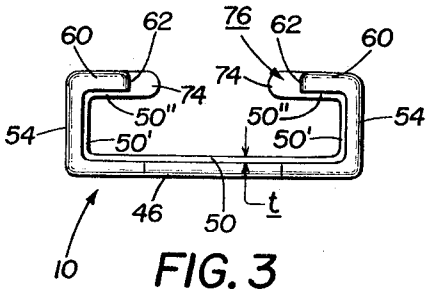
FIG. 3 is an end view of the channel end cap looking at the right side of FIG. 2 and showing the step area.

Turning now to channel end cap 10, as best seen in FIGS. 1, 2 and 3, it is preferably constructed of a flexible resilient material such as, for example, a polypropylene copolymer, but other plastic, elastomeric or rubber-type materials can also be utilized. Channel end cap 10 is also of generally rectangular form in transverse cross section and complementary with that of channel member 12 as best seen in FIG. 6. Channel end cap 10 has a predetermined axial extent or length L (FIG. 2) preferably at least as great as the transverse extent of channel member 12 and a substantially flat bottom wall 46 having a perpendicular step area 50, of predetermined height t (FIG. 3), spaced a predetermined distance (FIG. 5) from the radiused axial front end surface 52 of bottom wall 46.

Figure 7:
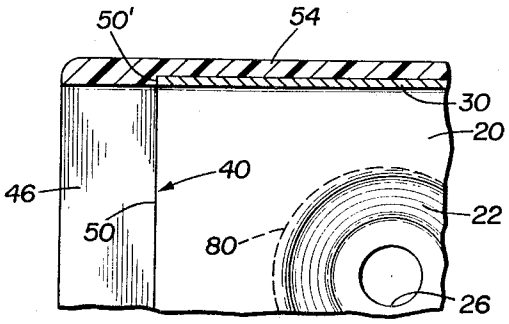
FIG. 7 is a longitudinal fragmentary sectional view taken on line 7—7 of FIG. 5 that shows the channel member engaging the step area of the channel end cap.
Figure 4:
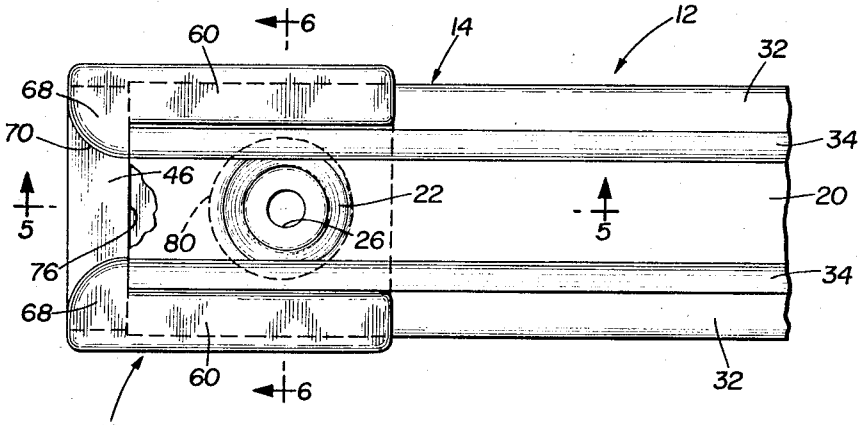
FIG. 4 is a top plan view of the channel end cap and the channel member in the assembled condition, with a small area of the channel member being broken away to show the step area.

The transverse ends of bottom wall 46 merge into opposed, similarly projecting parallel side walls 54 also having perpendicular step areas 50', of the same height and spacing, i.e., in same plane, as bottom wall step area 50. Side walls 54 in turn merge into inwardly converging spaced top walls 60 parallel to and equally spaced from bottom wall 46 whose opposite inner but spaced smooth end surfaces or edges 62 serve to define a central longitudinal slot 64. The width of top walls 60 may be as wide as that of channel top walls 32 minus the width of turned-over edge portions 34, and could be considerably narrower, but must be wide enough to envelop at least the outermost transverse portions of top walls 32 so as to confine channel member 12 against vertical movement. Top walls 60 also have perependicular step areas 50'', again of the same height and spacing, i.e., in same plane as bottom wall step area 50. Furthermore top walls 60 are provided with laterally inwardly extending front end or outer end portions 68 having generally inwardly converging radiused outer end surfaces 70 whose opposed inner ends are spaced apart a distance equal to that channel member central slot 38. Top wall outer end portions 68 also have generally flat inner end surfaces 74, perpendicular to edges 62, with surfaces 74 merging into and being in the same plane as step areas 50''. For ease of understanding, step areas 50, 50', 50'' and surfaces 74 (as best seen in FIG. 4) together form an axial intermediate surface area 76 which approximately corresponds in profile with channel axial end surface 40. Since heights t of step areas 50, 50' and 50'' are the same as material thickness t of channel member 12 and surfaces 74 will contain the end profile areas of turned-over edge portions 34, the assembly of channel end cap 10 with channel member end 14 permits an abutment and smooth transition between channel member axial end surface 40 and channel end cap axial intermediate surface 76 in the manner best shown in FIGS. 5, 6 and 7. The sizing of channel end cap 10 relative to channel member 12 permits a slip fit therebetween as best seen in FIG. 6. The inherent elasticity of channel end cap 10, together with its enveloping shape relative to channel member 12, contributes to the retention of channel end cap 10 relative to channel member 12.

Figure 5:
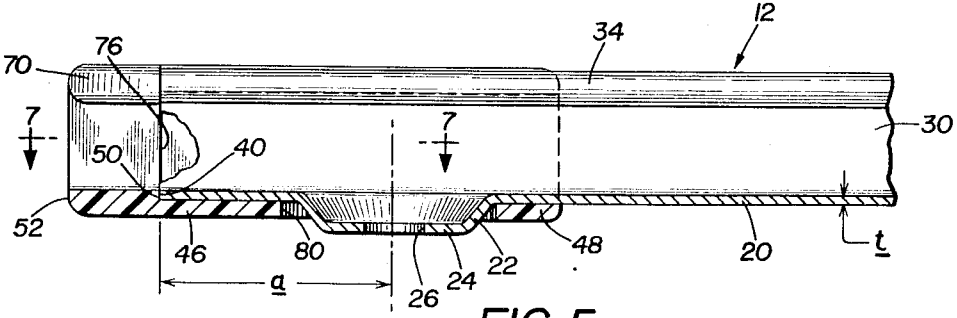
FIG. 5 is an enlarged longitudinal sectional view taken on line 5—5 of FIG. 4, with a small area of the channel member again being broken away to show the step area.

One preferred embodiment of channel end cap 10 has its bottom wall 46 provided with an aperture or opening 80 of a predetermined diameter, at least as great as, or preferably slightly larger than, that of channel member protrusion 22 so that aperture 80 is able to physically retain channel member protrusion 22. Furthermore, the distance a' from the center of aperture 80 to surface 76 (FIG. 2) is preferably slightly less than distance a (FIG. 5), namely the spacing from the center of channel member protrusion 22 to its axial end surface 40. Thus, due to the slight interference or press-fit, the axial rearward portion of protrusion 22 makes actual contact with the axial rearward wall portion defining aperture 80 (as best seen in FIG. 5), thereby physically biasing channel member end surface 40 into contact with end cap intermediate surface or abutment area 76 thereby physically locking end cap 10 onto channel member 12. The inherent elasticity of end cap 10 also permits a slip-fit assembly of these two elements, with end cap bottom wall portion 48, e.g. the portion of bottom wall 46 axially rearwardly of aperture 80, deforming sufficiently to permit the passage thereover of channel member protrusion 22.

It should, of course, be understood that during actual installations, channel member 12 may be so cut that channel protrusion 22 is totally absent at the joinder area with channel end cap 10, but, as previously noted, the inherent elasticity of the end cap material, together with its enveloping shape will permit both the assembly and subsequent retention of channel end cap 10 relative to channel member 12. In the absence of a protrusion 22, an end cap 10, without aperture 80 in its bottom wall 46, may of course also be utilized.

From the previous description it should be clear that the assembly of a channel end cap 10 and a channel member end portion 14 merely entails sliding one relative to the other after first axially aligning same in the manner shown in FIG. 1.

The channel end cap of the present invention finds specific utility in mechanical fastening systems utilized for securing EPDM sheeting in roofing applications. However, from the foregoing description, when read in the light of the several drawings, it is believed that those familiar with the art will readily recognize and appreciate the novel concepts and features of the present invention. Obviously, while the invention has been described in relation to only a limited number of embodiments, numerous variations, changes, substitutions and equivalents will present themselves to persons skilled in the art and may be made without necessarily departing from the scope and principles of this invention. As a result, the embodiments described herein are subject to various modifications, changes and the like without departing from the spirit and scope of the invention with the latter being determined solely by reference to the claims appended hereto.

What is claimed is:

1. The combination of an end cap physically secured to an end portion of a channel member and covering the axial outer end surface thereof, said channel member being of generally rectangular form, in transverse cross section, having a substantially flat bottom wall, similarly projecting side walls, and top walls parallel to said bottom wall, said top walls having contoured inner edges separated by a continuous central longitudinal slot, said end cap being comprised of a flexible resilient material of a generally rectangular form, in transverse cross section, and of a predetermined axial extent having:

(a) first bottom and side wall portions enveloping the corresponding adjacent walls of said channel member, said end cap also having first top wall portions enveloping at least the transverse outermost portions of said channel member top walls;

(b) second bottom, side and top wall portions extending respectively, from said corresponding first wall portions, axially outwardly of said channel member axial outer end surface; and (c) abutment means intermediate said first and second wall portions acting as stop means and abutting said channel member axial outer end surface.

2. The combination of claim 1 wherein the outer axial surfaces of said first and second portions of said end cap bottom, side and top walls lie in the same respective planes and wherein the inner axial surfaces of said first and second portions of said end cap bottom, side and top walls lie in the same respective planes as the inner axial surfaces of the corresponding walls of said channel member.

3. The combination of claim 1 wherein said channel member bottom wall further includes an outwardly directed protrusion centered a first distance from said channel member axial outer end surface and having a first dimension, said end cap first bottom wall portion having an aperture centered a second distance from said abutment means and having a second dimension, said second dimension being such so as to permit the physical retention of said channel member protrusion while said second distance is preferably slightly less than said first distance so as to physically bias said channel member axial outer end surface against said abutment means.

4. The combination of claim 1 wherein each of said end cap second top wall portions includes a transversely extending flat inner end surface coplanar with and abutting the adjacent axial outer end surface of said channel member top wall, and a radiused outer end wall surface diverging outwardly from said flat inner end surface to the axial outer end surface of said end cap side wall second portion.

5. The combination of claim 4 wherein said end cap second top wall flat inner end surface forms a portion of said abutment means.

6. The combination of claim 1 wherein said abutment means takes the form of step areas intermediate and perpendicular to said first and second portions of at least said end cap bottom and side walls.

7. The combination of claim 6 wherein the walls of said channel members are of a thickness substantially similar to the perpendicular extent of said step areas.

8. The combination of claim 6 wherein said end cap step areas all lie in a common place.

9. An end cap comprised of a flexible resilient material, of a generally rectangular form in transverse cross section, of a predetermined axial extent having:

(a) a substantially flat first bottom wall portion, similarly projecting first side wall portions, and first top wall portions parallel to said first bottom wall portion, said first top wall portions being separated by a continuous central longitudinal slot of a first width, (b) second bottom, side and top wall portions extending respectively from said corresponding first wall portions, (c) abutment means intermediate said first and second wall portions, (d) said second top wall portions being separated by a second longitudinal slot of a second width.

10. The end cap of claim 9 wherein each of said second top wall portions includes a transversely extending flat inner end surface, perpendicular to said first top wall portions, and a radiused outer end wall surface diverging outwardly from said flat inner end surface to the axial outer end surface of said sidewall second portion.

11. The end cap of claim 9 wherein said first bottom wall portion is provided with an aperture of a predetermined dimension centered a predetermined distance from said abutment means.

12. The end cap of claim 9 wherein the outer axial surfaces of said first and second portions of said bottom, side and top walls lie in the same respective planes.

13. The end cap of claim 9 wherein the inner axial surfaces of said first and second portions of said bottom and side walls lie in separate but parallel planes.

14. The end cap of claim 9 wherein said abutment means takes the form of step areas intermediate and perpendicular to said first and second portions of at least said bottom and side walls.

15. The end cap of claim 9 wherein said first width is a fixed width and said second width is a variable width.

16. The end cap of claim 15 wherein said step areas all lie in a common plane.

* * * * *